US005198075A

United States Patent [19]

Nivelleau de La Brunière et al.

[11] Patent Number: 5,198,075

[45] Date of Patent: Mar. 30, 1993

[54] DIGESTION METHOD AND INSTALLATION WITH PREHEATING OF LIGNOCELLULOSE MATERIALS IN SOLID PHASE

[75] Inventors: Patrick Nivelleau de La Brunière; Jean P. Galichon, both of Paris, France

[73] Assignee: Tag Pulp Industries S.A., France

[21] Appl. No.: 695,619

[22] Filed: May 3, 1991

[30] Foreign Application Priority Data

May 7, 1990 [FR] France ..... 90 05701

[51] Int. Cl.[5] ..... D21C 1/02; D21C 1/06; D21C 7/06; D21C 7/08

[52] U.S. Cl. ..... 162/19; 162/52; 162/57; 162/68; 162/90; 162/243; 162/246

[58] Field of Search ..... 162/19, 68, 250, 52, 162/246, 57, 243, 18

[56] References Cited

U.S. PATENT DOCUMENTS 3,293,118 12/1966 Putnam et al. ..... 162/250
3,664,919 5/1972 Clayton et al. ..... 162/68
4,092,212 5/1978 Richter et al. ..... 162/19
4,790,905 12/1988 Nivelleau de La Bruniere ... 162/56

OTHER PUBLICATIONS

Abstract Bulletin of the Institute of Paper Chemistry, vol. 54, No. 4, Oct. 1983, p. 422, V. Galichev et al.
Abstract Bulletin of the Institute of Paper Chemistry, vol. 54, No. 3, Sep. 1983, p. 355, G. Kosaya et al.

*Primary Examiner*—Steve Alvo
*Attorney, Agent, or Firm*—Ostrolenk, Faber, Gerb & Soffen

[57] ABSTRACT

A method of digesting lignocellulose materials impregnated with solutions of hydroxides or salts of alkali or alkaline earth metals, the ratio by weight of the solution retained during the impregnation and the dry matter being less than 2, in a digester, characterized by subjecting the impregnated materials before the digestion to a treatment with live steam under a pressure equal to or greater than that present in the digester so that a part of the steam, by giving off its sensible heat to the impregnated material and condensing, assures the preheating and penetration of the impregnation liquor up to the center of the material. The time of digestion is shorter and the pulp obtained more homogeneous.

3 Claims, 1 Drawing Sheet

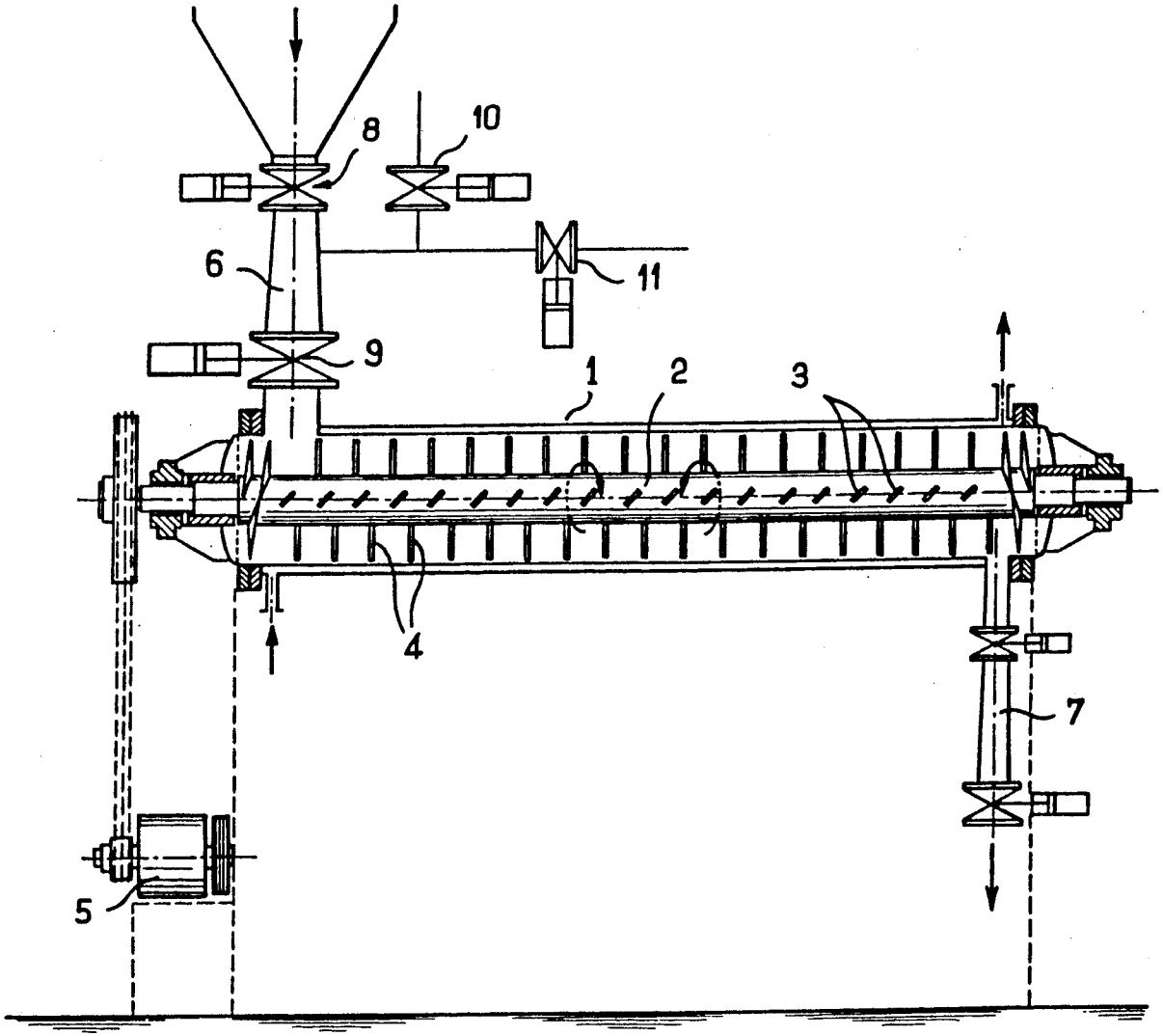
1
2
3
4
5
6
7
8
9
10
11

DIGESTION METHOD AND INSTALLATION WITH PREHEATING OF LIGNOCELLULOSE MATERIALS IN SOLID PHASE

The present invention relates to a method and installation for the digestion of a pasty or semi-solid mass of lignocellulose materials impregnated with solutions of hydroxides or salts of alkaline or alkali earth metals.

Methods of preparing of cellulose pulp by treatment of lignocellulose materials in which the digestion is effected in solid phase are already known, for instance from French Patent A-2 542 021.

The method described in said patent consists in effecting the digestion within a cylinder which is heated exclusively from the outside, without direct addition of steam, of a pasty mass of cellulose materials impregnated with alkaline or alkali-earth bases the content of which in the impregnation solution used is adjusted to a relatively low value, and the content of hydroxides or salts of which, absorbed during the impregnation, is relatively high. The prior impregnation is carried out, in particular, under conditions such that the ratio of the impregnation liquid retained (I.L.) and of the dry substance (D.S.) is equal to or less than 2.

Under such conditions, the material which is subjected to the digestion is almost solid and the digestion presents difficulties, in particular due to the non-uniform distribution of the heat given up by the wall of the furnace. It has already been proposed, in particular in accordance with French Patent Application 88 15085, to effect better control of the temperature during the course of the digestion and to reduce to an utmost the variations in temperature within the treated mass by controlling the conditions of filling and the rate of advance of the mass in an externally heated horizontal cylinder provided with a central screw with blades or vanes.

The consumption of heating power being related to a large extent to the water content of the impregnated lignocellulose materials, it is advantageous to decrease the I.L/D.S. ratio as much as possible, for instance by operating with a ratio of 0.7 to 1.3.

It is noted, however, that below 1.3 problems of heat exchange with the wall of the digester arise very sharply, which has the effect of increasing the digestion time.

Now it has surprisingly been found that one can overcome this difficulty and even operate with lignocellulose materials impregnated with an I.L/D.S. ratio of less than 1 up to values of 0.7 to 0.8, by subjecting the impregnated materials to the action of live steam.

The method of the present invention is characterized by subjecting the impregnated materials, before introduction into the digester, to the treatment with live steam under a pressure equal to or greater than that present in the digester so that a part of the steam by giving off its sensible heat to the impregnated material and condensing assures the preheating and penetration of the impregnation liquor up to the center of the material.

Such a preheating also results in a slight increase in the I.L./D.S. ratio, since a part of the steam condenses.

Impregnated materials whose I.L./D.S. ratio may vary between 0.7 and 1.3 are preferably subjected to the action of the live steam.

The steam pressure may vary between 5 and 10 kg/cm$^2$.

Thus, as the impregnated material, as a result of the action of the live steam, experiences an increase in temperature of about 100° C., there is an increase in the I.L/D.S. ratio in the following proportions.

For an initial I.L./D.S. value of 0.7, this value increases after the application of the live steam to 0.92.

For an initial I.L./D.S. value of 0.8, said ratio is 1.04 after the steam treatment.

This manner of operation makes it possible considerably to reduce the time of digestion, that is to say, by one-half or more of the time necessary without prior action of the steam.

Another object of the invention is an installation for the carrying out of the above method comprising an externally heated cylinder provided with a central screw with blades or vanes, which is characterized by the fact that the device for feeding the cylinder with impregnated material comprises a chamber lock connected to a live steam conduit.

Other features of the invention will become evident from the description of the examples of application of the invention given with reference to a digestion installation shown in the accompanying drawing.

BRIEF DESCRIPTION OF THE DRAWING

The sole FIGURE is a diagrammatic representation of a digestion installation of the present invention.

The digester of the invention comprises a cylindrical vessel with double jacket 1 traversed by hot oil, within the axis of which cylinder there is a horizontal screw 2 the inclined blades 3 of which are separated by non-inclined blades 4. The rotation of the screw is effected by a motor 5.

The entrance and discharge of materials are located at the opposite ends of the cylinder, each having a chamber lock, 6 and 7, provided with push pistons. The entrance chamber lock 6, at the openings of which the valves 8 and 9 are located, is connected via a conduit provided with a valve 10 to a source of live steam. The same conduit can also be connected to the open air via a valve 11 for the evacuation of the steam which has been used.

EXAMPLE 1

500 kg of bagasse of 65% dryness are impregnated with 17 kg of powdered anhydrous $NA_2CO_3$ and 40 kg of powdered caustic soda.

Onto the vigorously agitated mass there are sprayed 300 ml of water at 90° or 95° C. and the agitation is maintained for about 10 minutes. A fibrous homogeneous mass which is easy to manipulate and is of a straw-yellow color is obtained in which the I.L./D.S. is 0.8.

The impregnated bagasse, which weighs 587 kg, is separated into two parts.

The first part is treated in the digester without preheating by means of steam with a digestion time of 20 minutes at a temperature of 165°-168° C.

The second part is treated with steam preheating for 30 seconds at a pressure of 7.5 kg/cm$^2$ before introduction into the digester. The digestion time is 10 minutes at a temperature of 165° to 168° C. The results were as follows.

| Time of stay | Temp. | Steam treatment | Kappa Index | Undigested percentage |
|---|---|---|---|---|
| 1st lot | | | | |
| 20 min. | 165-168° C. | no | 27 | 1.5% |

-continued

| Time of stay | Temp. | Steam treatment | Kappa Index | Undigested percentage |
|---|---|---|---|---|
| 2nd lot | | | | |
| 10 min. | 165-168° C. | 37 sec, 7.5 kg | 15 | 0.3% |

Despite a reduced period of digestion, there is noted better digestion (lower kappa) and a more uniform pulp (lower percentage of undigested matter).

EXAMPLE 2

Kenaf cut to an average length of 3 cm is used. The entire plant is employed, with the exception of the leaves. The cortical fiber is not removed.

400 kg of kenaf of 84% dryness are mixed vigorously with 20 kg of powdered anhydrous sodium carbonate and 47 kg of powdered caustic soda.

While maintaining the agitation, 121 liters of water of 90° to 95° C. are sprayed onto the mass and the agitation is continued for 10 minutes.

The I.L./D.S ratio is 0.75.

As previously, the impregnated kenaf is separated into two lots. The first is introduced into the digester without prior treatment with steam with a time of digestion of 30 minutes at 165° to 168° C.

The second lot is treated for 30 seconds with steam under a pressure of 7.5 kg/cm$^2$ and then introduced into the digester. The time of digestion is 15 minutes at 165°-168° C.

The results obtained are summarized in the following table.

| Time of stay | Temp. | Steam treatment | Kappa Index | Undigested percentage |
|---|---|---|---|---|
| 1st lot | | | | |
| 30 min. | 165-168° C. | no | 31 | 1.6% |
| 2nd lot | | | | |

-continued

| Time of stay | Temp. | Steam treatment | Kappa Index | Undigested percentage |
|---|---|---|---|---|
| 15 min. | 165-168° C. | 30 sec, 7.5 kg | 18 | 0.2% |

In accordance with this example, it is also noted that, despite a shorter period of digestion, the steam treatment permits better digestion and the obtaining of a more homogeneous pulp.

The invention is not limited to the embodiments shown; it is capable of variations within the scope of the person skilled in the art.

What is claimed is:

1. A method for the pulping of raw lignocellulose material which consist essentially of the steps of:

impregnating said lignocellulose material with a solution of hydroxides or salts of alkali or alkaline-earth metals;

adjusting the weight of liquid retained in said lignocellulose material, so that the ratio of the weight of said retained liquid to the dry weight of said lignocellulose material does not exceed 2;

introducing the impregnated material into an air lock, introducing live steam into said air lock to contact said impregnated material in a precooking step, transferring the steam treated material from said air lock into an externally heated closed cylindrical digestion vessel provided with a central screw having blades or vanes for transporting said treated material through the vessel, transporting the treated material through said vessel while cooking it by externally applied heat, and withdrawing the cooked material from said digestion vessel via a second air lock;

the pressure of the live steam in said precooking step being equal to or greater than in the cooking step.

2. A method according to claim 1, wherein the weight of the retained impregnation liquid to the dry weight of said lignocellulose material is between 0.7 and 1.3.

3. A method according to claim 1, wherein the live steam is employed at a pressure of 5-10 kg/cm$^2$.

* * * * *